United States Patent [19]

Pierce, Jr. et al.

[11] 4,185,548

[45] Jan. 29, 1980

[54] TENSIONER DEVICE FOR PACKAGE TYING MACHINE

[75] Inventors: Paul Pierce, Jr., LaGrange; Robert G. Beedy, Hometown, both of Ill.

[73] Assignee: B. H. Bunn Company, Alsip, Ill.

[21] Appl. No.: 892,995

[22] Filed: Apr. 3, 1978

[51] Int. Cl.[2] ..... B65B 13/10

[52] U.S. Cl. ..... 100/27; 57/31; 226/195; 264/285

[58] Field of Search ..... 100/27, 28, 19, 21, 100/22, 33 P, 33 B, 32; 242/75.2; 226/88, 195; 28/219; 57/31, 259, 260; 264/285, 339

[56] References Cited

U.S. PATENT DOCUMENTS

| | | | |
|---|---|---|---|
| 658,206 | 9/1900 | Collins | 100/27 |
| 2,471,304 | 5/1949 | Bunn | 100/27 X |
| 2,593,585 | 4/1952 | Madgwick | 226/88 X |
| 2,883,822 | 4/1959 | Dorschner | 57/31 |

*Primary Examiner*—Billy J. Wilhite

[57] ABSTRACT

An improved tensioning device, for tensioning the tying medium of a package tying machine, is mounted on the tying machine's rotatable twine arm. The tensioning device utilizes a funneling structure to gather the tying medium, whether twine or tape or other material, into a prescribed volume while tensioning the same, thereby allowing a relatively high, uniform tension value to be maintained in the tying medium throughout the package tying cycle.

10 Claims, 7 Drawing Figures

TENSIONER DEVICE FOR PACKAGE TYING MACHINE

BACKGROUND OF THE INVENTION

1. Field of the Invention

This invention relates to package tying machines, and more specifically to the twine tensioning devices of such machines. This invention is in the nature of an improvement upon the machine disclosed and claimed in U.S. Pat. Nos. 1,606,290, dated Nov. 9, 1916; 2,371,024, dated Mar. 6, 1945; and 2,898,847 dated Aug. 11, 1959.

2. Description of Prior Art

Reference is made to the above identified patents and also to U.S. Pat. No. 2,873,664, dated Mar. 25, 1954, wherein the structure and operation of a spring controlled twine tensioning device, as well as the overall operation of a package tying machine, are disclosed and described. Proper tensioning of the tying medium (twine, tape, or other tie material), of course, is necessary to assure a properly tied knot and that the tying medium is sufficiently taut around the package.

It is sufficient to note that prior art package tying machines utilized a spool of twine from which a free end passed up through a series of guides, on through a twine tensioning device, through the machine's hub and rotatable twine arm, and on through another series of guides and rings until held by a stringholder mechanism disposed in proximity to the knotter mechanism of the tying machine.

With specific reference to U.S. Pat. No. 2,898,847, the typical prior art tensioning device disclosed therein was mounted between the twine supply and the hollow shafted twine arm and utilized a flat plate with an opening through which the twine could pass. The twine was biased against the flat plate by a leaf spring to establish the proper tensioning of the twine. The leaf spring could be pre-adjusted to a proper spring force level as operating conditions required.

The leaf spring in that type of tensioning device merely yieldably moved out of the way when a twisted, bunched or otherwise thick portion of the material passed thereby. However, such prior art devices made no provision for overcoming the problems generated by the varying tension values of the tie material which resulted from spring force variations of the tensioner. These spring force variations were caused by the constant moving of the spring in response to variations in tie material thickness.

This tension variation problem is of special concern when the so-called "poly tape" type tying medium is utilized, such as, for example, polyethylene or poly florin tape. Unlike twine, poly tape has unique characteristics during a tying cycle in that it tends to curl and fold over upon itself from an initially flat condition as it unrolls off the supply roll to a multiply-twisted ribbon. Accordingly, when entering the twine tensioner of the prior art tying machines, poly tape had a constantly changing thickness and volume.

As noted above, any variation in poly tape thickness—from a few thousandths of an inch up to a few hundreths of an inch—resulted in a varying tape tension throughout the tying cycle since the spring controlled twine tensioner was pre-set to operate at a constant spring force level for a constant tape thickness. Because of the variable tension problem, prior art tensioners had to be set so that the maximum tape tension resulting from the thickness variation would not pull the tape from under the tying machine's stringholder button. This ultimately resulted in an average tape tension that was far less than the strength of the tape would otherwise allow. This in turn resulted in undesirable wrapping and knotting conditions for poly tape.

An additional problem with the prior art leaf spring/-flat plate type tensioning devices, including the device disclosed in U.S. Pat. No. 2,898,847, is that utilization of twine therein required use of a laterally radiused leaf spring to confine and maintain the twine underneath the longitudinal center line of the spring. This was done to keep the twine from tending to escape sideways or squirt out from under the pressure of the leaf spring at the latter's point of contact with the flat plate. However, utilization of poly tape with the same laterally radiused leaf spring produced ineffective tape tensioning as the tape would simply pass within the lateral radius at the spring's contact point. This required the provision of one type of tensioning device for use with twine and another type of tensioning device for use with poly tape materials.

An additional problem is that, while twine is relatively limp and when tensioned will still easily pass through the three or more required right angle bends of the hub assembly and twine arm, poly tape becomes rather rigid and stiff under tensioning. The result is that excessive drag is placed on the poly tape when passing through the various bends of the twine arm. This problem of excessive drag in poly tapes, when tensioned prior to entry to the twine arm, required a further undesirable reduction in the flat spring tension in prior art tensioner devices so as to not pull the tape out of the stringholder button mechanism.

SUMMARY OF THE INVENTION

The present invention solves these various prior art problems by providing a tensioning device for a tying machine which is mounted on the rotatable twine arm thereof so as to eliminate drag by not tensioning the tie material until after it has passed through some of the bends in the twine arm. The present device comprises a funnel-type tensioner structure which, in effect, gathers up the tape or twine or other tying medium such that when it passes under the present invention's flat spring, it is presented in a consistent thickness and volume. This in turn allows a uniform tension level in the poly tape to be maintained, viz. the absence of poly tape thickness variations allows the spring to continually operate at a uniform spring force on the tape. Accordingly, both the stringholder button and twine tensioner devices can be set at maximum levels to maximize the tape tensioning for a tying cycle, whereby the full strength capabilities of the poly tape can be utilized to effect a more desirable, tightly wrapped and tied package. Moreover, the present device is usable with both poly tape and twine tie materials, thereby eliminating the prior art need for two different type tensioning devices.

Accordingly, it is a primary object of the present invention to provide a tensioning device for a package tying machine which accurately controls and uniformly establishes the tension of the tying medium during the tying operation.

It is another object of this invention to eliminate any excessive drag on the tie material when passing through a tying machine's twine arm by locating the tensioning device on the twine arm itself.

It is a further object of this invention to provide a tensioning device which works equally well with both twine and tape tie materials.

It is a still further object of this invention to establish a consistent size for the tie material before tensioning the same so as to assure a consistent tension value therefor.

The means by which the foregoing and other objects of the present invention are accomplished and the manner of their accomplishment will be readily understood from the following specification upon reference to the accompanying drawings, in which.

DESCRIPTION OF THE PREFERRED EMBODIMENT

Figure 1:
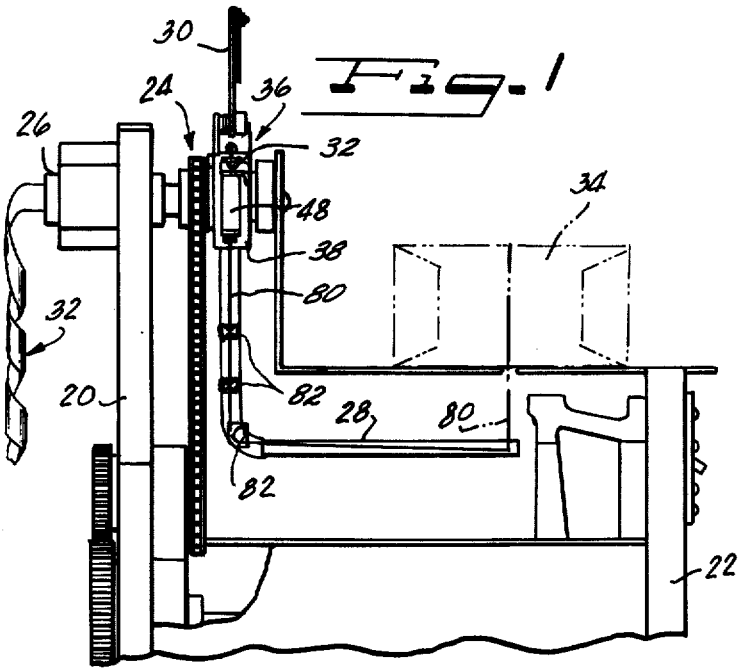
FIG. 1 is a side view of the upper portion of a typical package tying machine on which the improved tensioner device of the present invention can be utilized.

Having reference to the drawings, wherein like reference numerals indicate corresponding elements, there is shown in FIG. 1 an illustration of the upper portion of a typical package tying machine, generally denoted by reference numeral 20. The tying machine 20 is driven by a power supply (not shown). (Reference is again made to the previously identified U.S. patents for a more complete description of the structure and operation of a package tying machine.

Figure 4:
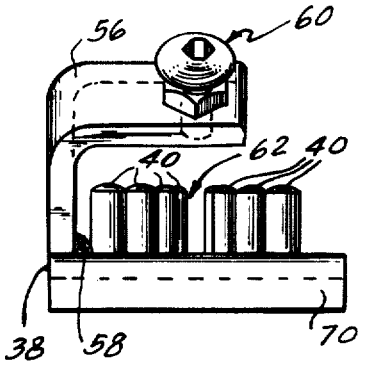
FIG. 4 is an end of the tensioner of FIG. 2 with the spring element removed.
Figure 2:
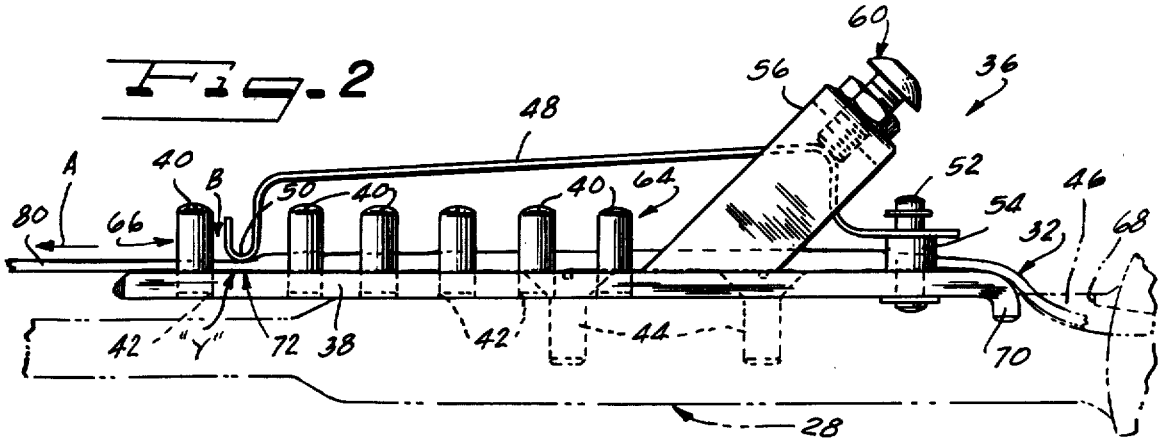
FIG. 2 is an enlarged side view of the tensioner device with associated parts in phantom.
Figure 3:
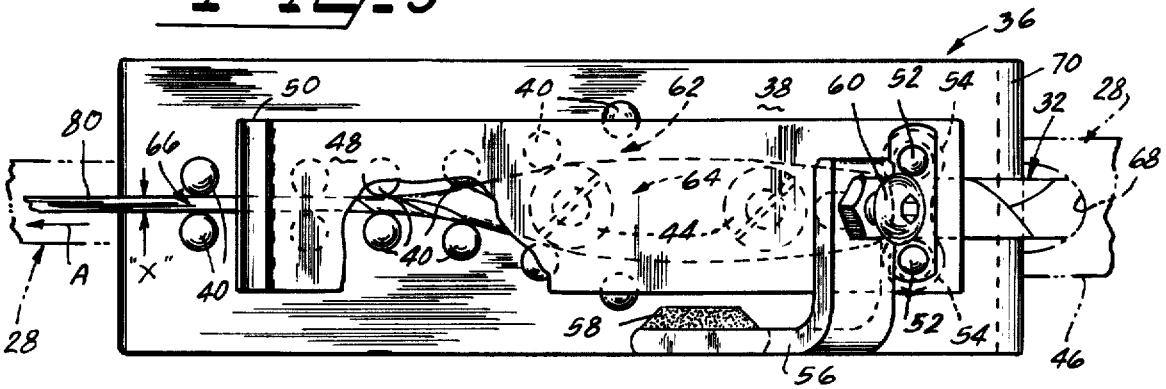
FIG. 3 is a plan view of the tensioner of FIG. 2 and having certain portions broken away for better viewing.
Figure 6:
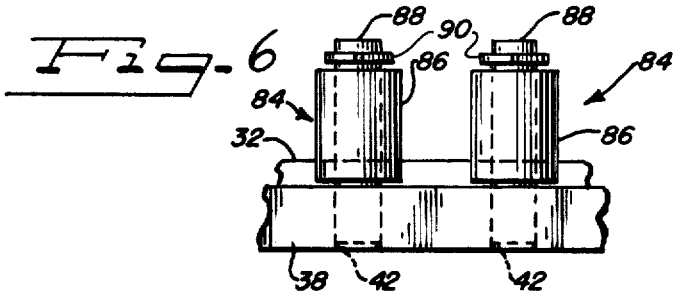
FIG. 6 is a partial side view of a typical package tying machine, such as is partially shown in FIG. 1, modified to show another location where the improved tensioner device of this invention can be mounted.

Tying machine 20 includes the usual frame 22, a power driven hub assembly 24 having a hub quill 26, a hollow-shafted, rotatable twine arm 28, a spring-biased drawback mechanism 30, and a tape supply 31 (FIG. 7) feeding a band of poly tape 32 for wrapping and tying around a package 34 (in phantom in FIG. 1). As shown in outline in FIG. 7, the tying machine 20 also includes the usual knotter mechanism 25 for tying a knot in the tie material, and the tie material holder mechanism 27 commonly called a stringholder button. The improved tensioning device of the present invention is denoted generally by reference numeral 36. As best seen in FIGS. 2 through 4, tensioner device 36 includes a support member or flat plate 38 into which a series of guide pins 40 are securely mounted, such as by being press-fit, for example, into a series of specially-aligned holes 42 formed in plate 38. As best seen in FIGS. 3 & 4, upstanding guide pins 40 and holes 42 are so formed relative to support plate 38 as to form a converging channel 62 along the plate 38, the use of which will be described later herein. Plate 38 is securely mounted to enlarged hub portion 46 of twine arm 28 through the use of appropriate fastening means, such as for example, fasteners 44. (This placement of tensioner device 36 directly onto twine arm 28, contrary to being placed near the twine supply as in prior art devices, see FIG. 7, has a special purpose which will be discussed later herein.)

A specially configured flat spring 48 having a contact lip portion 50 is fastened by a set of fastener pins 52 projecting through a pair of spacers 54 to plate 38 (FIGS. 2 & 3). An angle bracket 56 is mounted, such as by welding at 58, to plate 38 and carries an adjusting nut assembly 60, the lower end of which is capable, when properly adjusted, of applying pressure to spring 48 (FIG. 2) so as to adjust and pre-set the spring force exerted by lip 50 thereof.

FIG. 4 depicts the end view (from the right of FIG. 2) of tensioner device 36, with the flat spring 48 and the fastener pins 52 and spacers 54 removed for better viewing. A converging channel 62 is seen to be formed between the upstanding guides or guide pins 40. As best seen in FIG. 3, this converging channel 62 has an enlarged entrance end portion 64 (see righthand portion of series of dowel pins 40 in FIG. 3) and a tapered or constricted exit end portion 66 (see lefthand or tapered end of series of guide pins 40 in FIG. 3).

As best seen in FIG. 1 the band of poly tape 32 (or other tie material such as twine, for example) is drawn off of a supply roll 31 (FIG. 7) by the action of the twine arm 28. As the poly tape 32 unrolls from the supply roll, it has a tendency to curl before entering the power driven hub assembly 24. Turning to FIGS. 2 & 3, this twisted and curled band of poly tape 32 then passes through the hollow central axis portion of hub assembly 24, exits through hole 68 in enlarged hub portion 46 of twine arm 28, and travels over curved end lip 70 of plate 38. Poly tape band 32 then glides along plate 38 underneath the right end of spring 48 (FIG. 2) and between spacers 54. At this point the tape is traveling in the direction of arrow A; it is typically in a partially twisted and curled condition near spacers 54. As the poly tape 32 passes from right to left in FIGS. 2 and 3, it tends to partially untwist and widen somewhat due to being drawn flat across plate 38 without any edge constraints, such as spacers 54 or the edges of hole 68 in hub portion 46 before entering the enlarged entrance end portion 64 of converging channel 62. As tape 32 contacts the mid portion of channel 62, the relative differences in width of band of poly tape 32 as compared to the distances between respective pairs of guide pins 40 causes the partially twisted poly tape 32 to become gathered, i.e., bunch up and fold over on itself. By the time the poly tape 32 exits through the constricted end portion 66 of channel 62, the poly tape 32 is gathered—in a horizontal direction as per FIG. 2—into a prescribed width dimension (see reference letter X in FIG. 3). Additionally, due to the downwardly-directed spring force of spring contact lip 50 onto tape 32 (see arrow B in FIG. 2), the relative vertical thickness of poly tape 32 at contact position 72 is compressed to a prescribed vertical dimension (see reference letter Y in FIG. 2). Accordingly, as poly tape 32 is drawn out of convergent channel 62, it is gathered and compressed into a strand of poly tape having prescribed, continuous, uniform cross-sectional dimensions.

Figure 5:
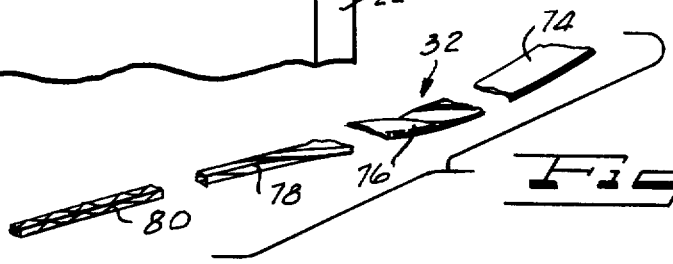
FIG. 5 is a segmented simulation in perspective depicting the effect of the present tensioner device on a poly tape tie material.
Figure 7:
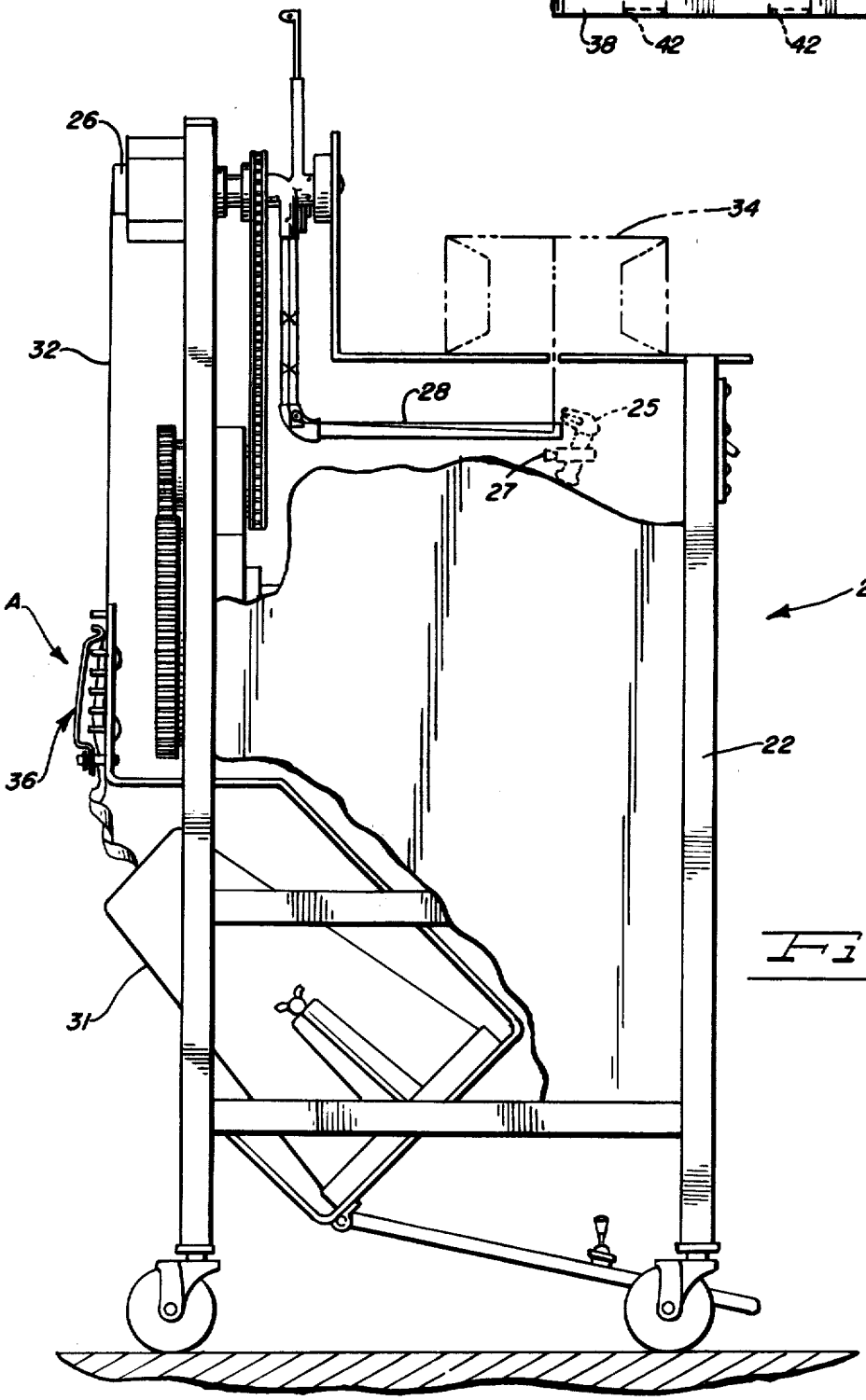
FIG. 7 is an enlarged side view, similar to FIG. 2, of a modified version of a component of the improved tensioner device.

This gathering and compressing action on poly tape band 32 due to tensioner device 36 is simulated in FIG. 5, wherein four separate tape segments are depicted in perspective. The right end tape segment 74 depicts the flattened tape 32 as it would appear coming off a tape supply roll. The right center tape segment 76 shows the beginning of twists and curls in tape 32 as it would look entering the right end of tensioner device 36 in FIGS. 2 and 3. The left center tape segment 78 depicts the gathering and bunching of tape 32 as it is drawn through the converging channel 62 of tensioner device 36. And finally, the left end tape segment 80 shows the compressed tape 32 having uniform dimensions as it emerges from tensioner 36. As more fully explained in the above-referenced patents, during a tying cycle then this compressed poly tape 80 is drawn on through the twine arm guides 82, wrapped about package 34, and held and knotted respectively by the associated stringholder button and knotter mechanism (FIG. 7 ).

Turning now to the overall operation of the present tensioning device in relation to the cyclic operations of a typical package tying machine, it is to be noted that because the tensioning of poly tape 32 does not occur until it reaches the tensioner device 36 mounted on twine arm 28, the poly tape 32 remains in a relatively untensioned condition until it has passed through some of the bends in the twine arm 28. Accordingly, there is only minimal frictional drag placed on the poly tape 32 as it passes from its supply roll through the hub assembly 24 and into the entrance end of tensioner 36. This eliminates the prior art problem of placing excessive drag on the poly tape through the hub portion of the rotatable twine arm assembly. Moreover, because tensioner device 36 uses a funneling principle, via converging channel 62, to positively place and maintain the tie material under spring lip 50, the present tensioner can be utilized with both twine and poly tape materials. The present tensioner 36 eliminates the prior art problem of tape squirting out from underneath a tensioner's leaf spring, and the need for a different tensioner device for tape compared to twine.

From the foregoing, it is believed that those skilled in the art will readily appreciate the unique features and advantages of the present invention over previous types of twine tensioning devices for package tying machines. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. As seen in FIG. 7, one such modification is to mount the present tensioner device 36 in a position (denoted as position "A" in FIG. 7) near the tie material supply 31, as was done with prior art package tying machines. Another modification would be to replace the guide pins 40 on plate 38 with a series of roller devices to further reduce friction on the poly tape during the tensioning operation. As seen in FIG. 7 where only two are shown for simplicity, such roller devices could take the form of a well known roller guide 84 comprising a roller sleeve 86 mounted on a pin 88 which is press fit into the hole 42. Such roller guide 84 would be positioned on plate 38 in a tapered pattern in similar fashion to the press fit guide pins 40, so as to form the channel 62. The sleeves 86 are retained to pins 88 by split ring retainer clips 90. It is therefore intended that the present invention be unrestricted by the foregoing description and drawings, except as may appear in the following appended claims.

The embodiments of the invention in which an exclusive property or privilege is claimed are defined as follows:

1. An apparatus for tensioning tie material in a package tying machine, comprising in combination, plate means mounted on the package tying machine, guide means aligned longitudinally of said plate means and characterized by a guide channel therealong said guide channel characterized as having an enlarged inlet end and a constricted outlet end, spring means mounted on said plate means and operable to resiliently engage the same at a position substantially at said constricted outlet end of said guide channel, whereby to form a substantially uniform cross section and a substantially uniform tension for tie material as it is forcibly drawn through said guide channel and beneath said spring means.

2. The invention of claim 1, wherein said guide means comprise a plurality of guide pins affixed to said plate means and forming said guide channel therebetween.

3. The invention of claim 1, wherein said spring means comprises a flat leaf spring.

4. The invention of claim 1, including tension force adjustment means mounted on said plate means adjacent said spring means and operable to adjust the spring force thereof.

5. The invention of claim 1, wherein said guide means comprise a plurality of roller guides mounted on said plate means and forming said guide channel therebetween.

6. A device for uniformly tensioning the tie material in a package tying machine of the type having a frame, power means, a tie material supply, a rotatable wrapper arm driven by said power means, a knotter mechanism, and a tie material holder mechanism, comprising in combination:

a support means mounted on the package tying machine;

a spring means mounted on said support means and operable to compressably engage the tie material against said support means at a contact position;

channel means on said support means and forming an elongated passageway for the tie material, said channel means characterized by having respective enlarged and constricted open ends, said constricted open end being proximate said contact position;

whereby as the tie material is forcibly drawn through said tensioning device during the operation of said package tying machine, said channel means and said spring means cooperate to form and gather said tie material into a uniformly consistent cross-sectional size, thereby allowing said spring means to exert substantially uniform tension forces on said tie material.

7. The invention of claim 6, wherein said support means is further characterized as being mounted on the rotatable wrapper arm of the package tying machine.

8. The invention of claim 6, wherein said support means is further characterized as being mounted on the tying machine frame adjacent the tie material supply.

9. An apparatus for tensioning tie materials in a package tying machine, comprising in combination:

support means mounted on the package tying machine;

guide means mounted on said support means and operable when the tie material is drawn therethrough to gather the same into a uniform cross-section; and spring means mounted on said support means and operable to forcibly engage said gathered tie material against said support means, thereby to produce a substantially uniform tension in the tie material as it is drawn through said apparatus.

10. An apparatus for uniformly tensioning the tying medium in a package tying machine, comprising in combination:

a support plate mounted on the package tying machine for providing a surface across which the tying medium can be drawn;

a plurality of guide members mounted in upstanding fashion on said support plate and further characterized as so positioned on said support plate as to cooperate to gather the tying medium, when the latter is drawn therealong, into a twisted strand having a prescribed width dimension; and spring means mounted on said support plate and characterized as compressing said tying medium into a prescribed height dimension by biasing the same against the support plate substantially at the location along said plate where said plurality of guide members gathers said tying medium into a prescribed width dimension, to thereby provide a substantially uniform tension in said tying medium.

* * * * *